US006155899A

United States Patent [19]

Boddy

[11] Patent Number: 6,155,899

[45] Date of Patent: Dec. 5, 2000

[54] FLOTATION DEVICE

[76] Inventor: Graeme James Boddy, 77 Eastern Terrace, Christchurch, New Zealand

[21] Appl. No.: 09/254,565

[22] PCT Filed: Sep. 12, 1997

[86] PCT No.: PCT/NZ97/00113

§ 371 Date: Mar. 8, 1999

§ 102(e) Date: Mar. 8, 1999

[87] PCT Pub. No.: WO98/10981

PCT Pub. Date: Mar. 19, 1998

[30] Foreign Application Priority Data

Sep. 13, 1996 [NZ] New Zealand ..... 299373

[51] Int. Cl.[7] ..... B63C 9/08

[52] U.S. Cl. ..... 441/130; 114/345

[58] Field of Search ..... 441/129–132, 441/35, 40, 65, 66; 114/345

[56] References Cited

U.S. PATENT DOCUMENTS

| | | | |
|---|---|---|---|
| 4,894,033 | 1/1990 | Chang | 441/130 |
| 5,217,400 | 6/1993 | Creek et al. | 441/132 |
| 5,571,036 | 11/1996 | Hannigan | 331/132 |

*Primary Examiner*—Ed Swinehart
*Attorney, Agent, or Firm*—Ross, Ross & Flavin

[57] ABSTRACT

An inflatable chair suitable for white-water use consisting of two inflatable floats (2, 3), rigid/semi-rigid seat base (4), bow hull floor section (12) an adjustable seat back (8) and a waterproof covering (7). The two inflatable floats (2, 3) are circular in cross section and taper at both ends to conical points (10, 11) at the stern and (13, 14) at the bow (6). The floats (2, 3) are separated by a rigid/semi-rigid central section (15) comprised of the seat base (4), bow hull floor section (12) which extends from the bow (6) for a majority of the chair's length, and together with the seat back (8) providing a semi-reclining body position enabling the user to use hands and/or legs for propulsion/manoeuvring.

25 Claims, 7 Drawing Sheets

FLOTATION DEVICE

TECHNICAL FIELD

The present invention relates to an improved float or chair for aquatic use. The float or chair is specially useful for recreational use on white-water rivers, though it will be appreciated that the chair could readily be used on any other body of water.

At present, personal flotation devices, fishing-floats, swimming-aids and white-water canoes/catamarans are well known. However, all these known flotation means are configured for use in a specific manner and do not meet requirements addressed by the present invention.

BACKGROUND ART

Known inflatable craft suitable for white-water use can be generally categorised as canoes/kayaks, catamarans, or rafts, although there is a degree of overlap with some hybrid craft.

Typical inflatable canoes or kayaks are approximately symmetrical about their lateral and longitudinal axes, with enclosed sterns, and utilise oars or paddles for propulsion. Although the use of hands is a possible alternative, it is impractical to use feet/leg power for manoeuvring and propulsion. Entry to, or exit from the canoe to the water is hindered by the inflatable tube forming the whole perimeter.

An intrinsic feature of canoe design is that they are very long in relation to their width, and thus somewhat constrained in their ability to manoeuvre in confined areas.

Catamarans with inflatable hulls, such as disclosed in U.S. Pat. No. 5,290,196, whilst enabling unobstructed access into and out of the seating position, require a rigid tubular frame to form the seat and secure the hulls. Although the seat can be folded flat to facilitate overland transport, via attached shoulder straps, the float is primarily intended for flat-water use, in particular for fishing/hunting: the seating position is high, relative to the hulls, and would be precarious for white-water use, given the relatively short hulls.

Inflatable catamarans capable of white-water use are required to be substantially bigger to achieve the required stability as the operator is sifting at a significant height above the water surface.

In order to obtain sufficient stability to minimise the risk of capsize together with the associated structural requirements, such craft tend to be substantial, expensive, cumbersome and unwieldy. In contrast to the kayaks/canoes, foot propulsion on catamarans is possible, but the width of the inflatable hulls and the height of the occupant above the water inhibit practical use of the hands and thus oars are generally utilised.

White-water rafts formed from a continuous inflatable tube in an elongated annular shape, with a rigid, semi-rigid or flexible floor, are well-known. They generally require several users, equally distributed on each side of the raft using paddles to propel and steer effectively. Again, foot propulsion is impractical.

Several types of floats suitable for non-white-water use are known, such as ring floats, tubes, horseshoe floats, chairs and pool floats/toys.

Annular inflatable tubes used by fisherman to access areas of a lake or stream unreachable from the shore are typically formed from a car tyre inner tube (or similar) covered by a fabric sleeve. A fabric seat is suspended from the ring allowing the whole of the lower torso to be submerged in the water and supporting the user in an upright position. Waders and swim fins are used by the fisherman in conjunction with this type of float. A drawback of such designs is the difficulty in getting in and out of the tube (especially when suitably attired for fishing) both ashore and following a puncture in the air bladder whilst in water.

The seating position is hydrodynamically inefficient and exposes the user's lower torso to underwater hazards, thus making white-water use in shallow rivers impractical.

Variations on annular inflatable designs are disclosed in U.S. Pat. No. 4,601,667, and NZ patent No. 61408. These all teach a seating position which may be maintained above the water, allowing just the lower legs to be submerged. Neither of these floatation devices has an efficient hydrodynamic shape or is suitable for white-water use due to the risk of injury from underwater obstructions. Ease of entry and exit from the water is again problematic.

U.S. Pat. No. 5,474,481, (continuation-in-part from U.S. Pat. No. 5,297,978) discloses a "diving well" inside the perimeter of the inflatable tube, with an elevated seating position with just the lower legs capable of immersion. The hull shape is however, restricted to an ovoid/annular shape. This configuration prevents the efficient, unrestricted use of flippers and due to the relatively large width of the float, hand propulsion is impractical, necessitating the use of oars and/or a motor.

To obviate some of the problems posed by such annular shaped floats, a number of horseshoe or "U" shaped—floats have been developed.

U.S. Pat. No. 5,217,400 discloses a U-shaped float formed by a single continuous tube with a flexible seating platform attached between the legs of the U. A tensioning strap attached to the end of the legs extends around the outside perimeter of the float. This strap is required to prevent the opposing legs collapsing towards each other under the weight of the user in the seat. Furthermore, the underwater profile of the hull makes no concession to hydrodynamic efficiency. The seating position is upright, being configured primarily to permit the user to engage in stationary activities such as fishing or hunting, rather than being optimised as a means of transport on the water. No protection would be available to the user's lower body in shallow and/or white-water, from any sub-surface hazards and the float has insufficient length relative to its width to provide stability in turbulent water.

The above mentioned requirement to maintain the structural integrity of an open-ended float has been addressed by differing means as disclosed in the following patents and designs:

U.S. design No. 341866 employs a "V" shape using a single tube of generally circular cross-section, with substantially more volume (and therefore buoyancy) in the apex of the V. The seat appears to be composed of a simple mesh fabric. The angular divergence of the two "hulls" gives some structural resistance to the weight of the user in the seat. Again, there is no consideration of the hydrodynamic efficiency of the hull form, nor to the protection of the user from submerged obstructions/hazards. In particular, the blunt shape of the region of the "V" together with the increased volume both contribute to reduce the directional stability and the potential speed of the float.

U.S. design No. 355466. This design incorporates a lateral bar spanning the open end of a U-shaped float.

U.S. design No. 349744. Similar to U.S. design No. 355466 but without the rear cross-member and with the inclusion of an additional seating well in the bow.

Both U.S. design No. 355466 and U.S. design No. 349744 have generally circular cross-sectional float tubes and a flat seat, parallel with the water surface, and appear to be designed for use as a recreational toy in swimming pools or similar non-dynamic environments. The proportions of both design would provide virtually no upper body support for a user positioned to be able to immerse their legs from below the knee for paddling.

U.S. design No. 362706. This shows a rectangular fishing float with a centrally-mounted rigid seat and a rectangular cut-out to enable the fisherman's lower legs to dangle in the water. The whole shape of this design is clearly not intended to minimise the friction of the hull through the water.

None of the above referenced patents/designs display any rocker at any of the sides/ends of the floats, with the profile of the underside being substantially parallel to the water's surface.

U.S. Pat. No. 1,465,790. This is a non-inflatable U-shaped float in which the users legs and lower torso are submerged during use. A seat suspended from the centre of the "U" holds the user in an upright position.

U.S. Pat. No. 1,503,624. This discloses a rigid, non-inflatable U-shaped float, with which the user adopts a prone position with their arms extending outside and to the front of the float. This permits a swimming action to be carried out with both the arms and legs. The whole of the user's lower torso is submerged in the water.

There are also various miscellaneous floats, which do not fall into the previously described categories, which are broadly relevant.

U.S. Pat. No. 3,543,712 teaches a swimming aid which is contoured on its upper surface to match the upper torso of the user, thus leaving the arms and the body below the hips free to move. The user adopts a prone position and can utilise means of powered proportion incorporated in the float, in addition to the arm and leg swimming action.

While some lateral stability is provided by the longitudinal "keel-like" underwater projections, the float would afford little protection to the user in a white-water environment.

U.S. Pat. No. 5,186,667. This floating hammock places the user in a face-up, reclining seating position. However, it is clearly not intended to facilitate any means of user propulsion and indeed, incorporates supports/rests for both the arms and feet. The user's midriff is immersed in water entering a via lateral openings in the side of the hammock. The float does not have an open transom, contains little structural integrity and is not robust enough for white-water use.

U.S. Pat. No. 5,360,360. This inflatable device is specifically intended for towing, both on the water and over snow. While the general appearance of the hull is U-shaped, the user or users is/are intended to sit/kneel/stand behind the side-walls. These walls are designed to provide protection from the effects of the elements whilst being towed. The underside of the float is flat and is intended to skim the surface of the water/snow rather than for human propulsion. While leg propulsion would be possible when not under tow, paddling by hand would be hindered due to the relatively high sides of the float.

DISCLOSURE OF INVENTION

It is an object of the present invention to provide a float capable of efficient human propulsion, using hands and/or legs, which secures the user in a semi-reclining position and which is sufficiently manoeuvrable, in both forward and reverse direction, to enable the user to engage in white-water river use whilst protecting the user's body and minimising the risk of snagging the lower surface on under water hazards.

The dimensions and proportions of the float are chosen with the object of providing high longitudinal stability in turbulent water.

It is a further object of the present invention, to engender in the user, a feeling of close, direct involvement with the environment, by virtue of close proximity of the seating position to the water.

A further object of the present invention is that the complete float be sufficiently light to enable easy transportation by a single person and be constructed in a manner enabling it to be readily dismantled and packed for easy stowage and transportation.

The present invention provides an inflatable chair configured to be primarily propelled by a user's hands and legs, comprising:

a hull which is arch-shaped in plan view, wherein the opposing sides of the arch are formed by one or more streamlined, inflatable and float(s);

a central semi-rigid or rigid section fills the area between the sides of the arch-shape from the apex which forms the bow of hull, towards the free ends of the arch which form the stern of hull;

and wherein the hull displays a degree of rocker approaching the bow; the lower surface of the central section is a hydrodynamically-efficient shape, describing a smooth, continuous curve from the bow towards the stern and extending to or below the waterline when in use; the upper surface of said central section providing lower and upper-body support for a user, in the form of a seat base between said opposing floats and a seat back adjacent said seat base, said seat back being located between said seat base and the bow; the overall length of the hull being substantially greater than that of the seat base; said hull, said seat base and said seat back being proportioned and dimensioned such that a user sitting on said seat base between the said floats with the user's back against the said seat back may immerse his/her legs below the knee while his/her upper body is supported clear of the water surface, enabling simultaneous immersion of his/her lower legs and hands into the water for propulsion and maneuvering.

Preferably, the or each float extends upwards from the upper surface of the central section to a level at or just above the user's legs/lower-body in use.

Preferably, said the inclination of said seat back is adjustable.

Preferably, the seat-back is releasably securable to said central section and/or the floats.

Preferably, the underside of the centre section rises towards the stern to a point at or near the waterline of the chair when in use.

Preferably, the hull also displays a degree of rocker at the stern.

Preferably, said inflatable floats extend beyond the sternmost edge of the centre section for a distance greater than 50% of the length of the seat-base.

Preferably, the aspect ratio of the overall length to the width is approximately 1.7–2.5:1.

Preferably, the overall length of the chair is approximately equal to the face height of the typical user (e.g. 1.6 meters for 1.8 meter person).

Preferably, an inflatable buoyancy means is inserted between the seat-back and the bow.

Preferably, each opposing side of the arch is formed by a single separate float or by two connected floats, each float extending substantially parallel to the longitudinal axis of the float.

Alternatively, both sides of the arch may be formed from a single continuous float.

Said central section may be made of any suitable semi-rigid or rigid material (e.g. foam material or an inflatable construction).

A major portion of the lower surface of the centre section may form a smooth continuous surface with the underside of the floats. Alternatively, the underside of the central portion may be recessed upwards relative to the underside of said floats.

Preferably, at least one end of said floats taper to a conical point.

Preferably, the underside of said floats and said central section is configured to permit surfing or planing.

Preferably, at least part of the said central section is made from shock absorbent material.

Preferably, said seat back is upwardly inclined from the said seat base towards the bow.

As used herein:

1) The term "rocker" means the upwards curvature or inclination, in a longitudinal direction, of the underside of the craft's hull.

2) A "semi-rigid or rigid section" is defined as including an inflatable, foam, or solid section, or any combination of these.

BRIEF DESCRIPTION OF THE DRAWINGS

By way of example only, a preferred embodiment of the present invention is described in detail with reference to the accompanying drawings, in which.

BEST MODES FOR CARRYING OUT THE INVENTION

Figure 1:
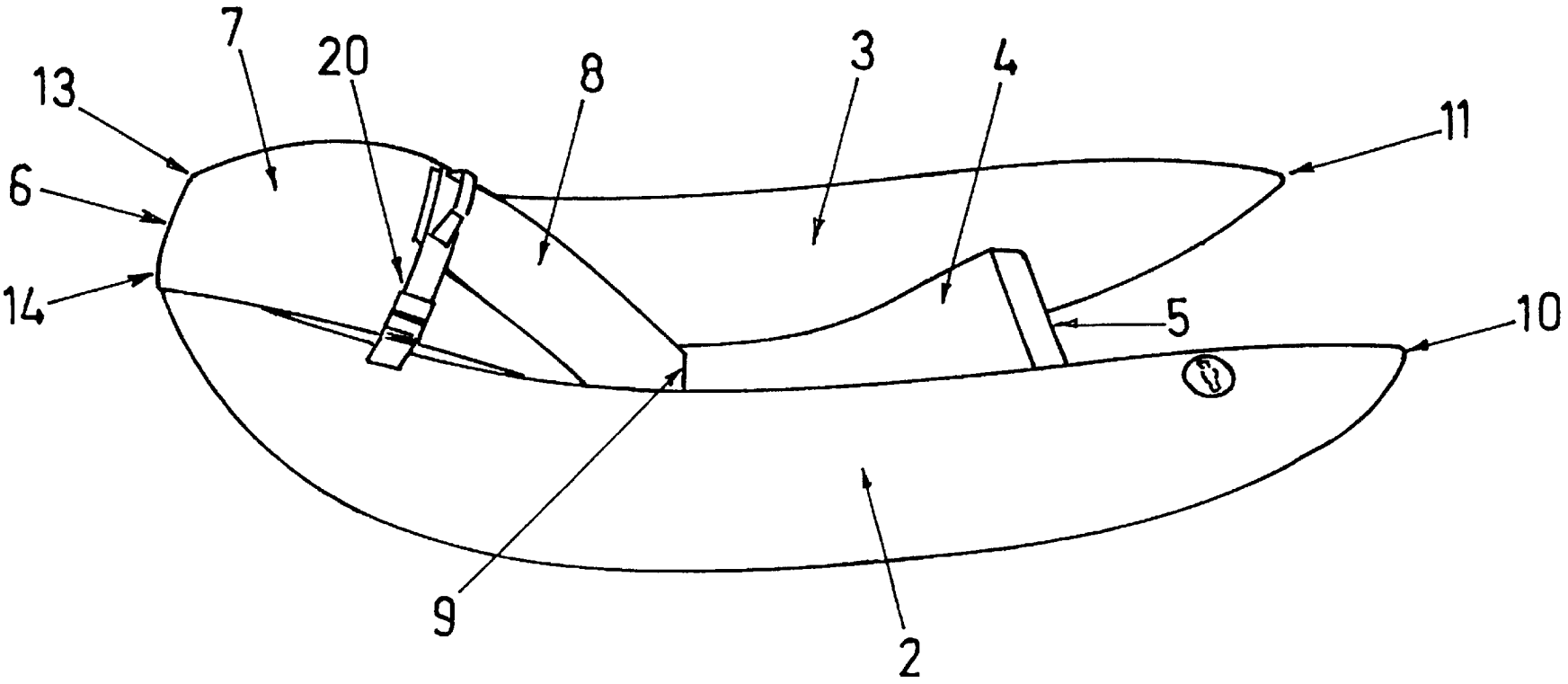
FIG. 1 is a perspective view from above of a first preferred embodiment of the present invention.

Referring to the drawings, the arch-shaped chair is comprised of two inflatable floats (2 & 3), a semi-rigid seat base (4), an adjustable seat-back (8), a bow hull floor section (12), a hull skin section (15*a*), an inflatable buoyancy bag (16) and a waterproof covering (7).

The two inflatable floats (2 & 3) are circular in cross-section and taper at both ends to conical points (10 & 11) at the stern and (13 & 14) at the bow. The longitudinal axes of the inflatable tubes (2 & 3) are orientated to converge towards the bow (6), (although they do not meet in this preferred embodiment) and are substantially parallel towards the stern.

Figure 4:
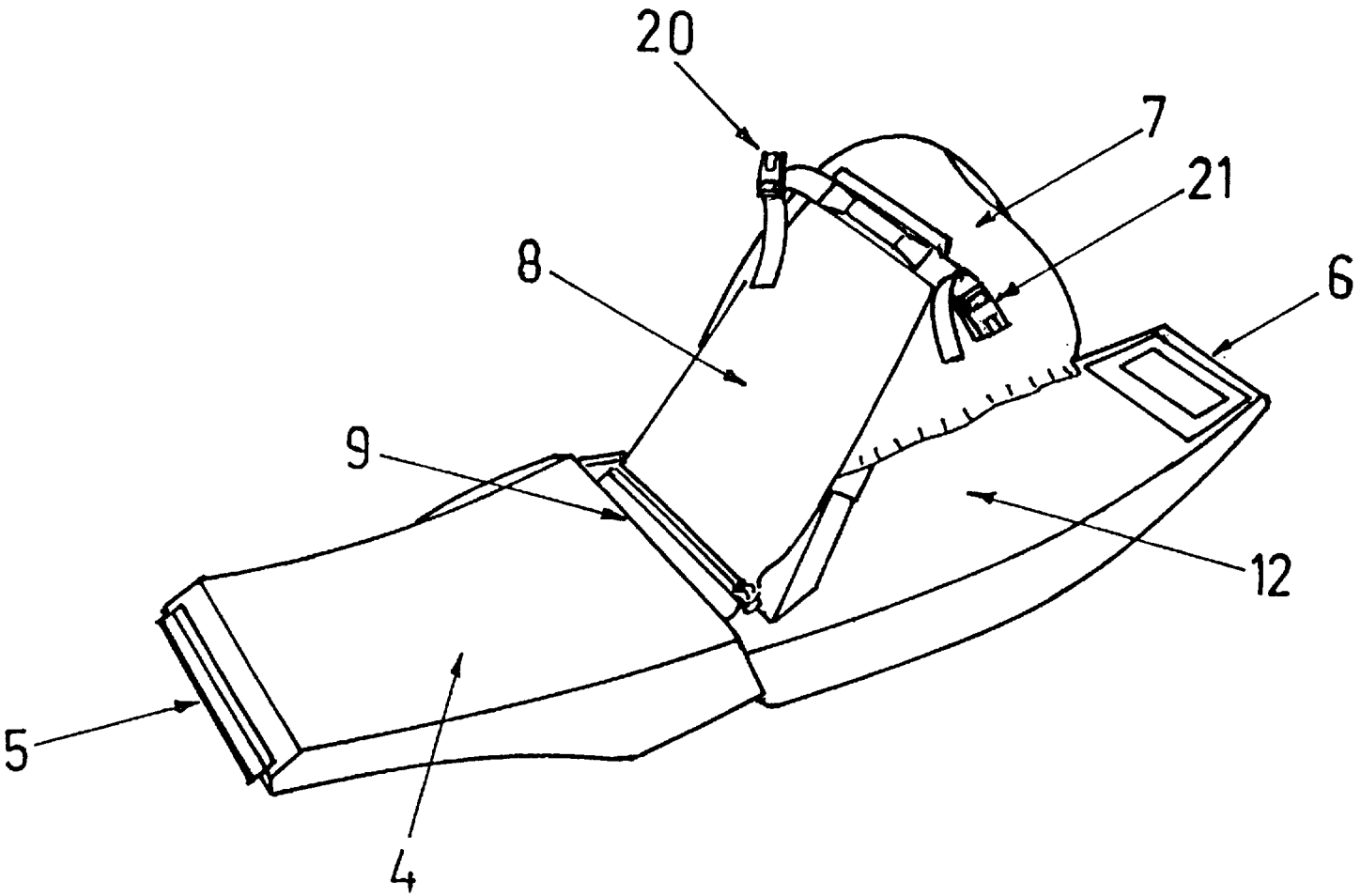
FIG. 4 is a perspective view of the seat components and semi-rigid central section removed from the chair of a first preferred embodiment of the present invention.

The hull skin section (15*a*) is permanently fixed (e.g. stitched, glued or, heat-welded) to the floats (2 & 3). As shown in FIG. 4 the seat-base (4) and the bow hull floor section (12) are hinged together (to enable them to be dismantled and compactly folded) and are secured (e.g. zip, clips) to the aft-edge (5) of the hull skin section (15*a*) and pushed between (and extend slightly under) the floats (2 & 3) and secured at the bow (6) by a hook-and-loop fastening. Alternatively, the seat-base (4), bow hull floor section (12) and the hull skin section (15*a*) may be combined together and attached to the floats (2 & 3) by longitudinal fastenings (not shown). In both alternatives, the seat-base (4) and bow hull floor section (12) are made from a semi-rigid foam.

A central section (15) formed from the combination of the hull skin section (15*a*) enclosing the area between the floats (2 & 3) and the attached seat-base (4) and bow hull floor section (12), delineates a smooth curve from the bow (6) extending below the water surface and rising to the edge of the seat base (5) which is approximately level with the water-line of the chair when in use. The underwater surface of both the floats (2 & 3) and the central section (15) is free from any protuberance or distortion and is conducive to maximising the hydrodynamic efficiency and lateral stability of the chair. The lower surface of the said central section (15) of the chair (i.e. the hull skin section (15*a*)) and the outer surface of the floats (2 & 3) form a single smooth continuous surface for a major portion of the length of the centre section and are made of a water—impervious, abrasion resistant flexible material such as PVC coated nylon or polyester.

A near rectangular, semi-rigid foam seat-back (8) with a covering, is zipped to the intersection (9) of the seat-base (4) and the bow hull floor section (12). The angle of inclination of the seat-back may be varied by adjusting straps (20 & 21) fixed from the side of the seat-back (8) to the floats (2 & 3) and/or adjusting the volume of an inflatable buoyancy bag (16) placed between the seat-back (8) and the bow hull floor section (12). An elastic-edged covering flap (7) is attached to the top of the seat-back (8) and stretches over the adjustable buoyancy bag (16) to the bow (6) where it is attached by an adjustable strap (19) or similar fastening.

Alternatively the seat-back (8) may be adjustably secured to the seat-base/bow hull floor section (4,12) or to the sides of the floats (2 & 3) to enable its longitudinal position to be adjusted. This permits users of differing physical stature to use the float. Preferably the user's knee will extend to a point just past the seat-base edge (5) enabling the portion of the legs below the knee to kick or float in the water. The floats (2 & 3) extend rearwards beyond the seat-base edge (5) for a distance greater than 50% of the length of the seat base 4, and preferably between 50% and 80% of said length. This distance is approximately equal to the position of the ankles of the extended leg of the seated user. This enables the float to provide sufficient buoyancy in the stern (preventing/minimising the likelihood of pitchpoling) while not hindering the use of the feet for kicking (with fins) or for fending-off boulders, rocks and similar obstacles.

The length to width aspect ratio is a critical design consideration which has been found to have an optimum value of approximately 1.7–2.5:1. The overall length itself is also an important parameter and should ideally be approximately equal to the height of the face (e.g. approximately 1.6 meters of a typical 1.8 meter user). These values will naturally alter with users of different stature, requiring chairs of different sizes to be produced for optimum performance.

The combination of the relatively long overall length together with extension of the floats (2 & 3) past the seat-base edge (5) provides a stable platform for the user to climb into the seat from the water without the chair tipping or flipping over.

The semi-reclining seat configuration and rigid or semi-rigid centre section provide the following advantages:

(i) Support, stability and comfort, enabling practical use for extended periods.

(ii) Places the user's legs in the optimum position for kicking, floating on the water surface, minimising drag, avoiding submerged hazards and for fending off rocks, boulders etc.

(iii) Efficient use of the user's arms for paddling—both forwards and reverse, enhanced by their ergonomically efficient position and close proximity to the water surface aided by the relatively narrow diameter of the tubes allowing the user to easily reach over the sides.

(iv) Minimises transom drag.

(v) A low centre of gravity, thus increasing stability.

(vi) Decreasing any tendency of the user to slide out of the open stern in turbulent water.

(vii) Lateral stiffness, preventing the floats (2 & 3) collapsing towards each other under the weight of the user and enhancing the overall structural integrity of the float.

(viii) The curved underwater profile prevents rocks/obstructions snagging and minimises the likelihood of damage, in both directions of travel.

(ix) Absorbs shock and protects the user's body between the midriff and the knees from any underwater collisions.

The volume between the seat back (8) and the hull floor is filled by the removable, inflatable buoyancy bag (16). After inflation, the bag completely fills the space behind the seat back (8), displacing any water that might otherwise settle there. This prevents any water splashing into the chair from being retained, as the buoyancy bag and the user's body fills all the available cavities/apertures and thus the float is in effect self-draining.

Equipment may be stored behind the seat-back (8), —preferably in a waterproof bag displacing part of the volume of inflated bag (16) and is retained in position by cover flap (7).

The user may be secured to the chair by means of quick-release straps (22 & 23). This enables the user to perform a variety of vigorous manoeuvres without becoming detached from the chair.

A number of handles (not shown) can be located along the upper surface of the floats (2 & 3) for use during such manoeuvres. Handles located near the ends (10 & 11) of floats (2 & 3) aid re-entry of the chair by a person in the water.

It will be appreciated that by varying the diameter of the floats (2 & 3) and therefore varying their buoyancy, the performance and response characteristics of the float can be altered.

Increasing the diameter of the floats (2 & 3) increases the overall stability and buoyancy of the float, minimising the risk of inversion. This would be desirable for heavier or less experienced users or, for example, for use in a commercial hire operation, where safety is paramount.

Decreasing the diameter of the floats reduces the overall stability and buoyancy of the chair, particularly the lateral stability, while increasing the ability to bank and roll. This enables experienced users to perform more advanced manoeuvres such as Eskimo rolls.

In a second preferred embodiment (shown in broken lines in FIG. 5) the floats (2 & 3) contain a small junction at the bow (located above the waterline) enabling the simultaneous inflation of both floats (2 & 3) via a single inlet valve. Substantially increasing the size of this inflatable junction between the floats (2 & 3) would enable its use as a seat-back, thus dispensing with the need for the removable seat-back (8) and buoyancy bag (16).

Figure 6:
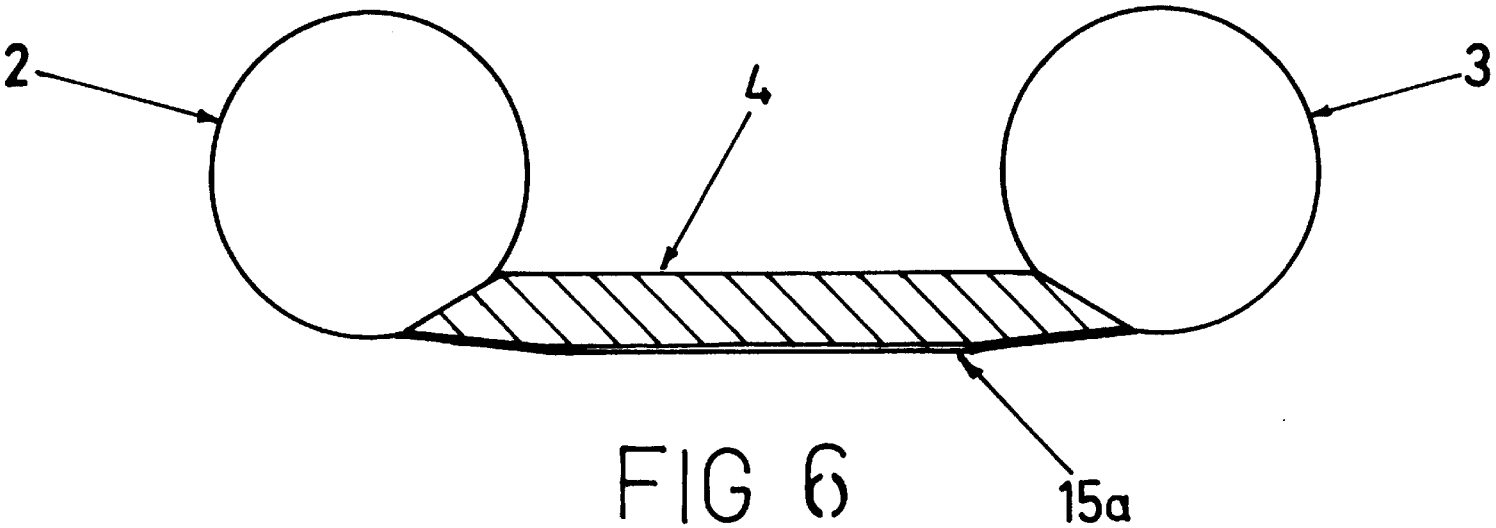
FIG. 6 shows a section through line C–D of FIG. 2
Figure 7:
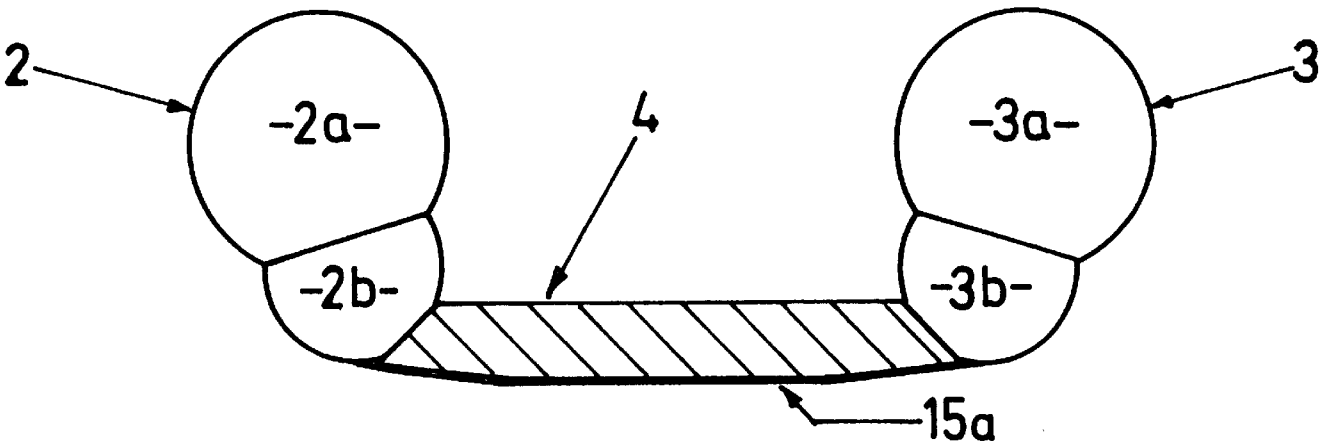
FIG. 7 shows a corresponding view to FIG. 6 of a third preferred embodiment.

As shown in FIG. 7, in a third preferred embodiment, each float (2 & 3) may be comprised of two or more inflatable tubes (2*a*,2*b*,3*a*,3*b*) with common adjoining walls. This configuration permits the diameter of the individual tubes to be reduced without necessarily reducing their combined cross sectional height. Different lateral cross-sectional profiles may be achieved by joining tubes of different diameters in various positions. FIG. 6 shows a cross-section through the line C–D.

FIG. 7 shows a corresponding cross-section through a third preferred embodiment with additional tubes (2*b* and 2*b*). Comparing FIGS. 6 & 7, it can be seen that floats (2 & 3) in FIG. 7 have a reduced diameter compared to that of the first and second preferred embodiment shown in FIG. 6. The additional floats (2*b* & 3*b*) are located below floats (2*a* & 3*a*) with their longitudinal axes closer inboard to the longitudinal axes of the chair than floats (2*a* & 3*a*). This float configuration retains a similar (or greater) cross sectional height to the same first/second preferred embodiments, but reduces the floats' overall width and buoyancy. The additional floats (2*b* & 3*b*) do not extend as separate identities for the entire length of the floats (2*a* & 3*a*), but merge with them at the bow and stern to form conical points.

Figure 8:
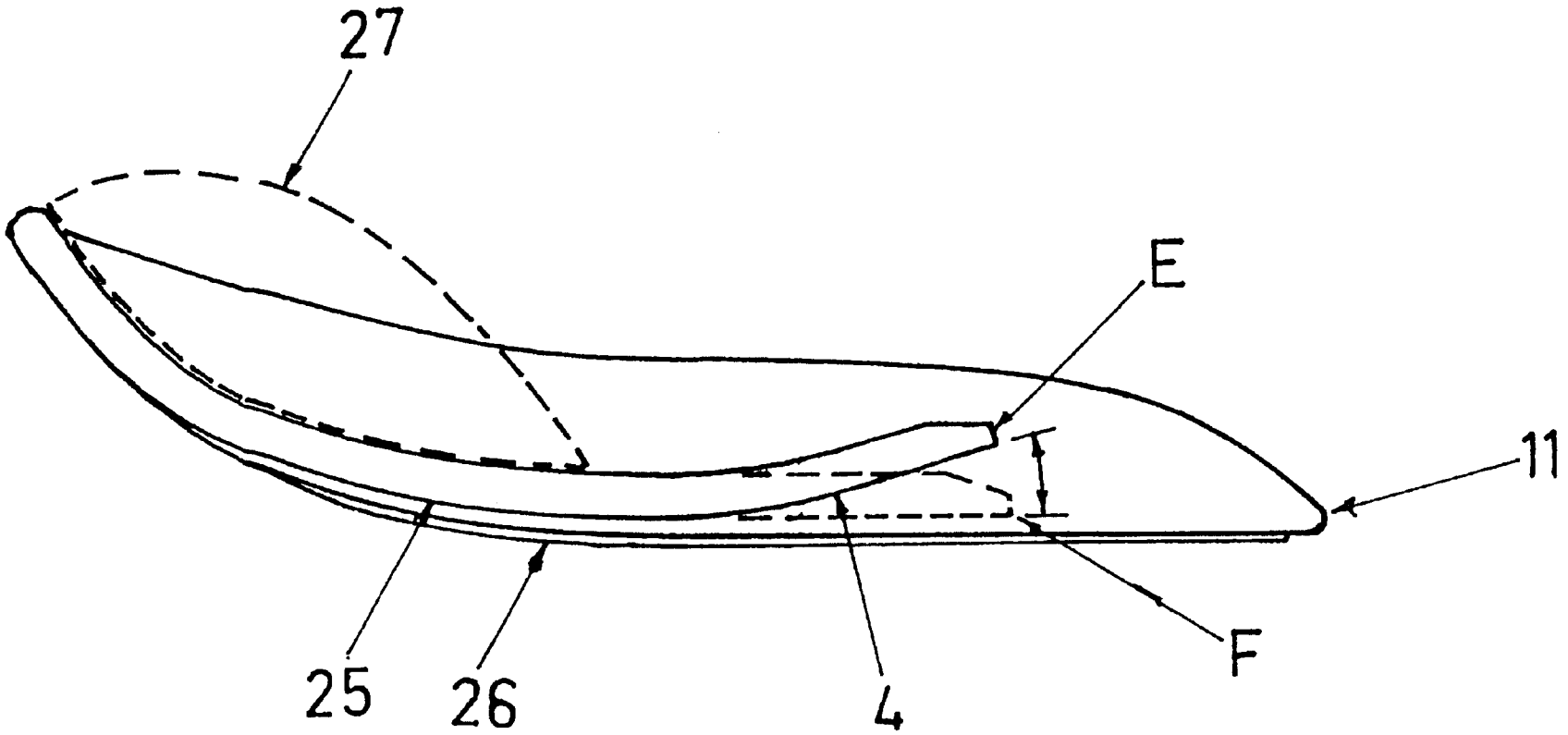
FIG. 8 shows a corresponding view to FIG. 3 of a fourth preferred embodiment.

In a fourth preferred embodiment, (as shown in FIG. 8) the chair is optimised for use on snow or for towing across water. In this embodiment, the chair is configured such that the underside of the seat-base (4) is parallel with (and ideally raised slightly from) a line drawn tangentially between floats (2 & 3), wherein said floats maintain a flat hull profile, aft of the seat base/seat back intersection (9), i.e. no rocker in the stern.

This may be achieved by replacing the curved seat-base (4), with a flat base or by the use of suitable adjustable fastening means on floats (2 & 3), altering the angle of seat-base (4) between positions E (raised towards the stern) or F (parallel to the water's surface). The characteristic features of the fourth preferred embodiment in comparison to the above described embodiments are;

no rocker at the stern, a slightly raised centre section (25) with respect to the bottom of floats (2 & 3), a longitudinal ridge (26) for directional stability on each float (2 & 3) and a simplified cushion/support pillow (27) replacing the seat back/buoyancy bag (8,16) assembly.

This configuration would also enable the user to adopt a prone position facing the bow.

Figure 5:
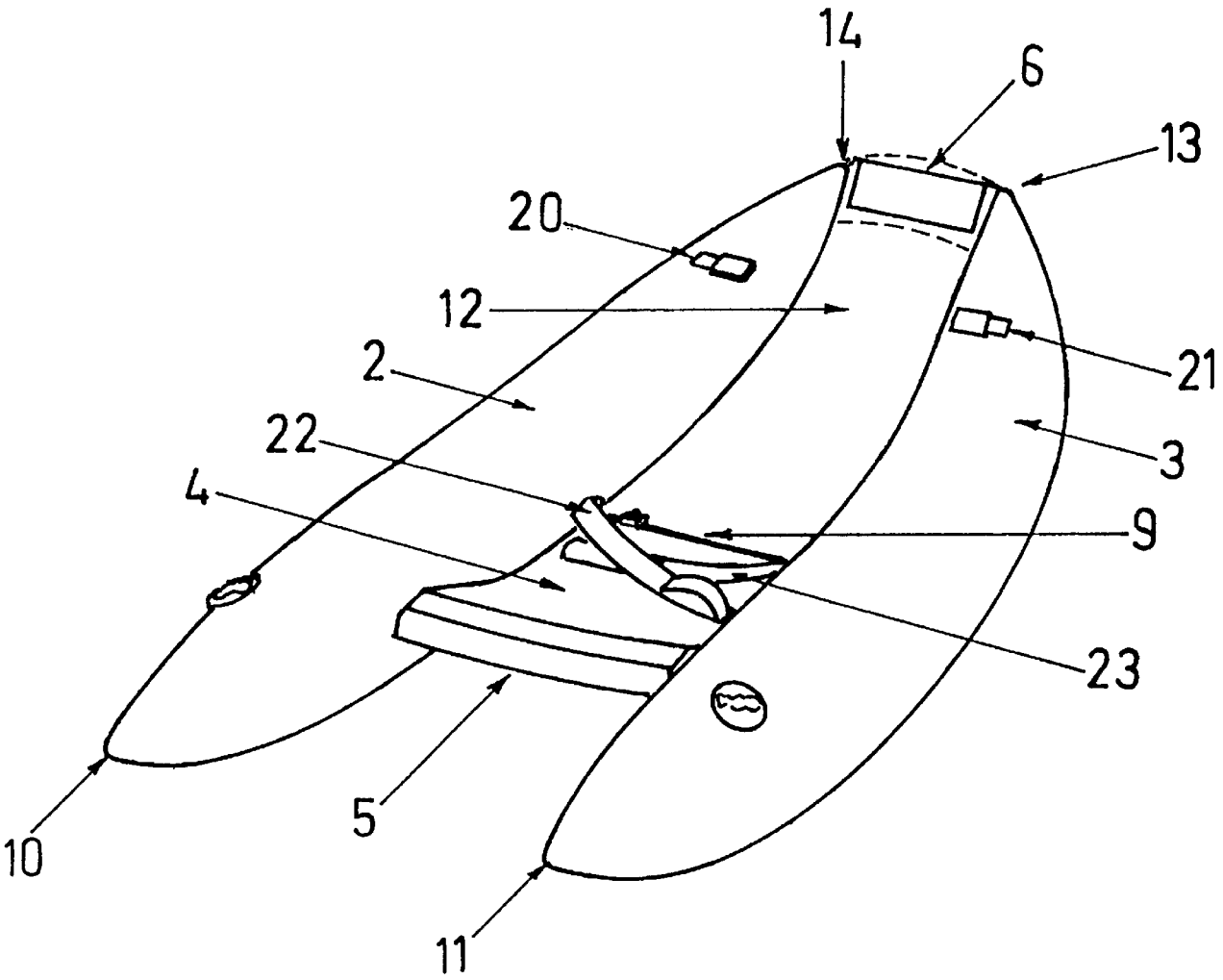
FIG. 5 is a further perspective view from above of a first preferred embodiment of the present invention, but with the seat back and buoyancy bag removed; a second preferred embodiment is shown in broken lines.

In a fifth preferred embodiment (not shown), a simplified configuration of the chair can be used as a rescue/survival aid. Preferably the floats (2 & 3) will be joined at the bow to form one continuous float (as shown in FIG. 5) and the seat-base (4) and bow hull floor section (12) also are inflatable. The chair incorporates means to automatically inflate when deployed into the water, whether from the shore, boat/yacht or aircraft. The enhanced mobility (and stability) of the chair (in comparison to known rescue means) would enable a conscious/uninjured user to easily climb into the seat and propel themselves towards help. Additional features which may be included in this type of embodiment could include a drogue (to prevent the float being blown away from the user), strobe light, dodger and attachment points for suitable lifting means to enable the stable raising of the float and user from the water by the rescuing water craft/helicopter.

It will be further appreciated that there are a variety of different configurations possible for all the embodiments by altering the geometry of the floats, the size and arrangement of the chair elements and the construction means/materials.

The angular relation of the centre line of the legs of the arch-shaped hull can range from being substantially parallel to converging at either bow or stern or both. The bow may be constructed to contain more intrinsic buoyancy, thus eliminating the need for a separate buoyancy bag (16).

In practice it has been found that on flat and/or slow moving water, the chair is paddled by the hands and/or feet in a bow-first direction. In fast flowing/white-water, the user faces downstream (i.e. stern first) being propelled by the current, and propels himself (using his legs and/or hands) at an angle against the current (ferry glide) as a means to navigate left or right to avoid hazards.

All the embodiments of the chair can also be used in a similar fashion to a body-board, with the user adopting a prone position facing the bow. Straps (20) or handles (not shown) located adjacent to strap (20) can be used by the user as a secure hand-hold in this body position.

The shape of the float under-side, particularly at the bow, promotes the ability to surf/plane on waves, especially the type of standing waves produced in some white-water and/or rapid rivers.

What is claimed is:

1. An inflatable chair configured to be primarily propelled by a user's hands and legs, comprising: a hull which is arch-shaped in plan view, wherein the opposing sides of the arch are formed by one or more streamlined, inflatable float(s) and a central semi-rigid section fills the area between the sides of the arch-shape from the apex which forms the bow of the hull, towards the free ends of the arch which form the stern of the hull; and wherein the hull displays a degree of rocker approaching the bow; the lower surface of the central section is a hydrodynamically-efficient shape, describing a smooth, continuous curve from the bow towards the stern and extending to or below the waterline when in use; the upper surface of said central section providing lower and upper-body support for a user, in the form of a seat base between said floats and a seat back adjacent said seat base, said seat back being located between said seat base and the bow; the overall length of the hull being substantially greater than that of the seat base; said hull, said seat base and said seat back being proportioned and dimensioned such that a user sitting on said seat base between the floats with the user's back against the said seat back may immerse his/her legs below the knee while his/her upper body is supported clear of the water surface, enabling simultaneous immersion of his/her lower legs and hands into the water for propulsion and manoeuvring.

2. An inflatable chair as claimed in claim 1, wherein the underside of the central section rises towards the stern to a point at or near the waterline of the chair when in use.

3. An inflatable chair as claimed in claim 1, wherein the hull also displays a degree of rocker at the stern.

4. An inflatable chair as claimed in claim 1, wherein the or each float extends upwards from the upper surface of the central section to a level at or just above the user's legs/lower-body in use.

5. An inflatable chair as claimed in claim 1, wherein the inclination of said seat back is adjustable.

6. An inflatable chair as claimed in claim 1, wherein the seat-back is releasably securable to said central section and/or the floats.

7. An inflatable chair as claimed in any one of the preceding claims, wherein said inflatable floats extend beyond the stern-most edge of the central section for a distance greater than 50% of the length of the seat base.

8. An inflatable chair as claimed in any one of claims 1–6, wherein the aspect ratio of the overall length to the width is approximately 1.7:1 to 2.5:1.

9. An inflatable chair as claimed in claim 7, wherein the aspect ratio of the overall length to the width is approximately 1.7:1 to 2.5:1.

10. An inflatable chair as claimed in claim 1, wherein the overall length is approximately equal to the face height of a typical user.

11. An inflatable chair as claimed in claim 1, wherein an inflatable buoyancy means is inserted between the seat-back and the bow.

12. An inflatable chair as claimed in claim 1, wherein each opposing side of the arch is formed by a single separate float.

13. An inflatable chair as claimed in claim 7, wherein each opposing side of the arch is formed by a single separate float.

14. An inflatable chair as claimed in any one of claims 1–6, 10, 11, wherein the opposing sides of the arch are both formed by two or more connected floats, each float extending substantially parallel to the longitudinal axis of the float.

15. An inflatable chair as claimed in claim 7, wherein the opposing sides of the arch are both formed by two or more connected floats, each float extending substantially parallel to the longitudinal axis of the float.

16. An inflatable chair as claimed in any one of claims 1–6, 10, 11, wherein both sides of the arch are formed from a single continuous float.

17. An inflatable chair as claimed in claim 1, wherein said central section is inflatable.

18. An inflatable chair as claimed in any one of claims 1–6, 10–12, 15, 16 wherein said central section is made of foam material.

19. An inflatable chair as claimed in any one of claims 1–6, 10–12, 15, 16 wherein said central section is made of a plastics material.

20. An inflatable chair as claimed in any one of claims 1–6, 10–12, 15, 16 wherein a major portion of the lower surface of the central section forms a smooth continuous surface with the underside of the floats.

21. An inflatable chair as claimed in any one of claims 1–6, 10–12, 15, 16 wherein the underside of the central portion is recessed upwards relative to the underside of said floats.

22. An inflatable chair as claimed in any one of claims 1–6, 10–12, 15, 16 wherein at least one end of said floats tapers to a conical point.

23. An inflatable chair as claimed in any one of claims 1–6, 10–12, 15, 16 wherein the underside of said floats and said central section is configured to permit surfing or planing.

24. An inflatable chair as claimed in any one of claims 1–6, 10–12, 15, 16 wherein at least part of the said central section is made from shock absorbent material.

25. An inflatable chair as claimed in any one of claims 1–6, 10–12, 15, 16 wherein said seat back is upwardly inclined from the said seat base towards the bow.

* * * * *

UNITED STATES PATENT AND TRADEMARK OFFICE

CERTIFICATE OF CORRECTION

PATENT NO. : 6,155,899
DATED : December 5, 2000
INVENTOR(S) : Graeme James Boddy It is certified that error appears in the above-identified patent and that said Letters Patent is hereby corrected as shown below:

Column 1,
Line 41, change "sifting" to -- sitting --

Column 3,
Line 4, change "design" to -- designs --
Line 34, change "proportion" to -- propulsion --
Line 46, before "via" delete "a"

Column 4,
Line 20, before "float (s) ;" delete "and" after "float (s); " add -- and --
Lines 23 and 24, between "of" and "hull" insert -- the --
Line 31, delete "opposing"
Line 45, change "said the" to -- the said --

Figure 2:
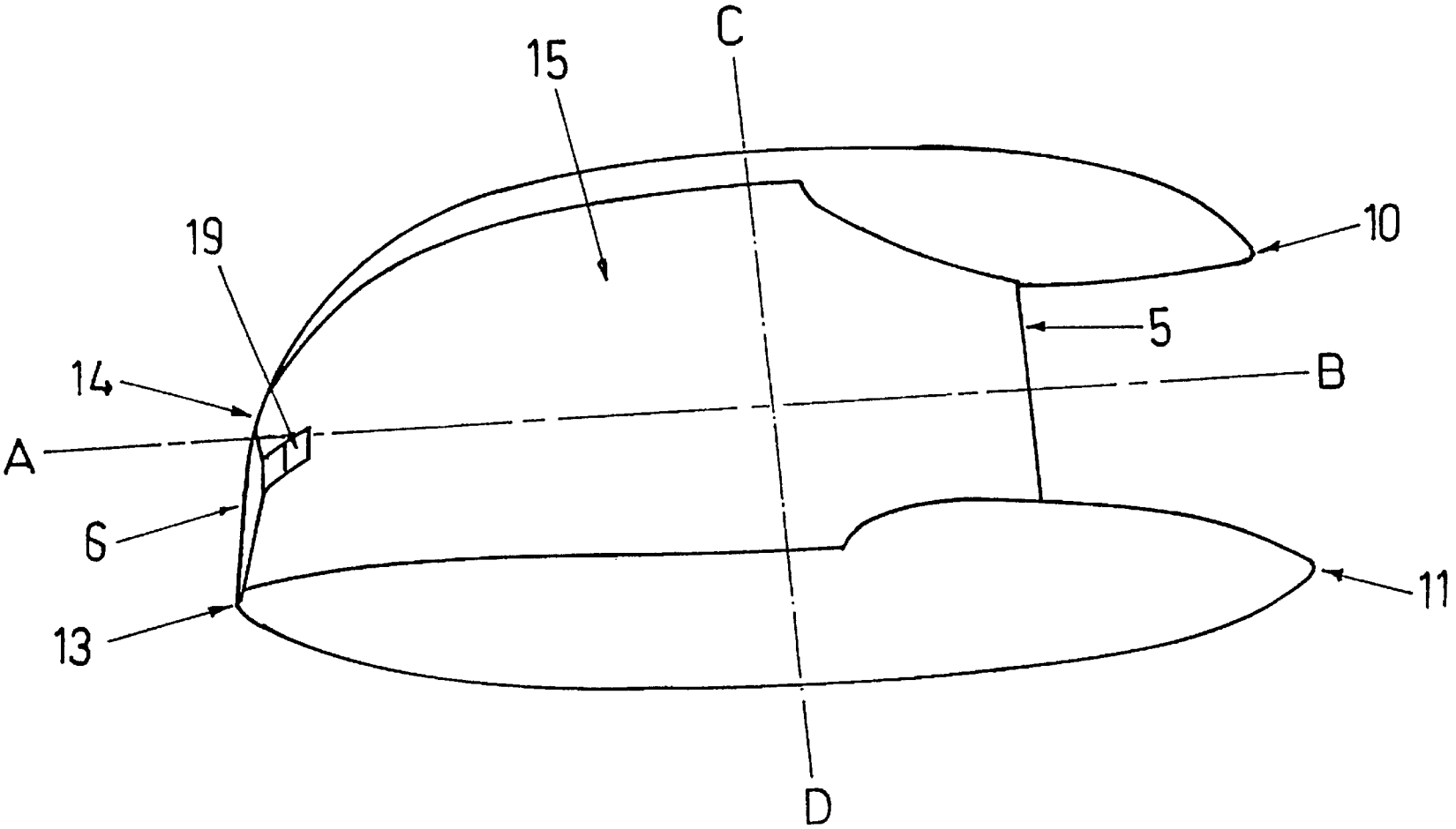
FIG. 2 is a perspective view from below of a first preferred embodiment of the present invention.
Figure 3:
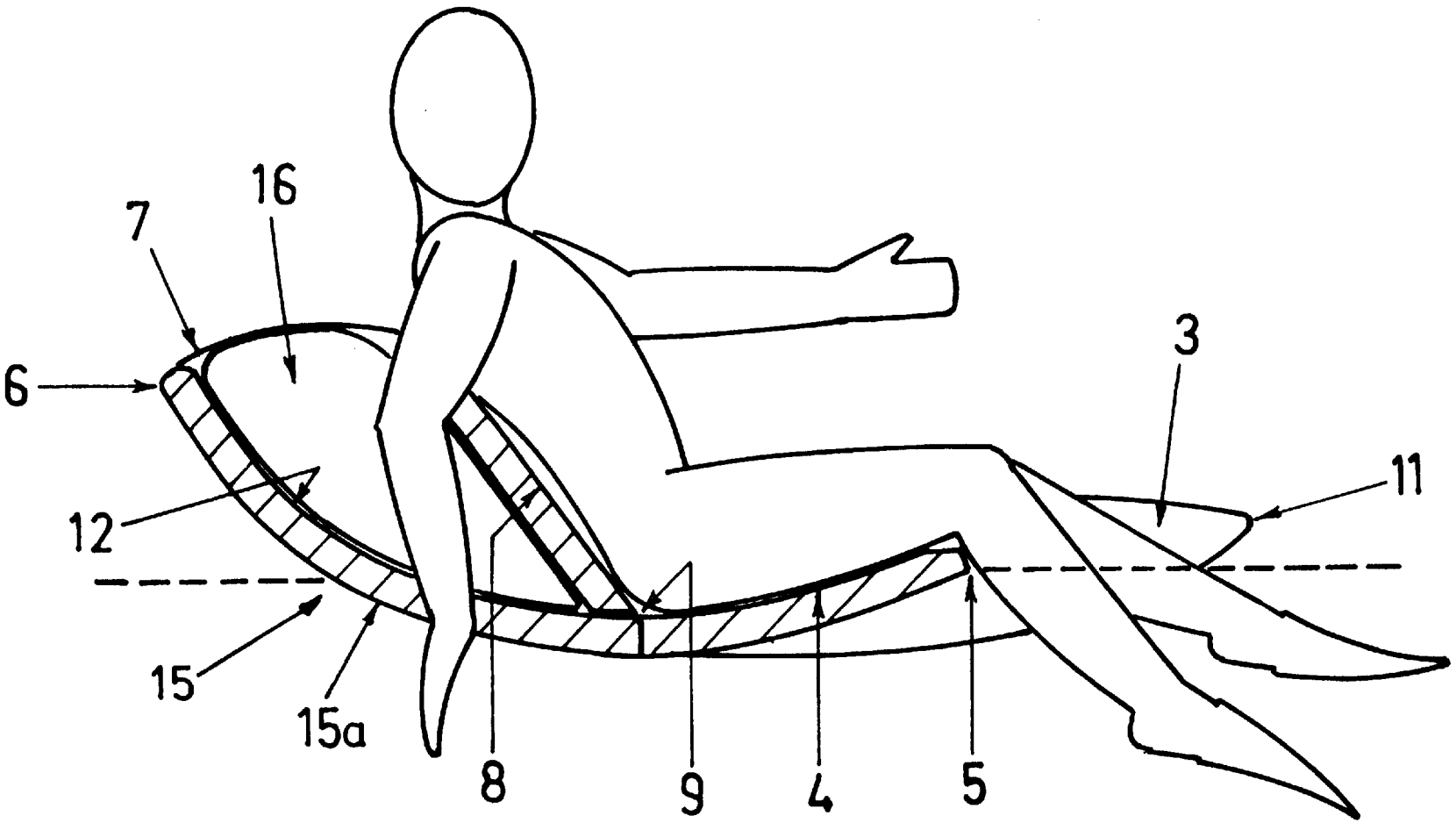
FIG. 3 is a section through line A–B of FIG. 2 (shown inverted)

Column 5,
Lines 32, 34 and 40, after "invention" change "." (period) to -- ; -- (semi-colon)
Line 44, after "lines" change "." (period) to -- ; -- (semi-colon)
Line 45, after "FIG. 2" add -- ; -- (semi-colon)

Column 8,
Line 18, change "2b)" to -- 3b) --

Column 10,
Each of Claims 18 - 25, change "16" to -- 17 --

Signed and Sealed this

Second Day of October, 2001

*Attest:*

Nicholas P. Godici

*Attesting Officer*

NICHOLAS P. GODICI
*Acting Director of the United States Patent and Trademark Office*